US007736465B2

(12) United States Patent
Ryan et al.

(10) Patent No.: US 7,736,465 B2
(45) Date of Patent: Jun. 15, 2010

(54) ANIONIC FUNCTIONAL PROMOTER AND CHARGE CONTROL AGENT WITH IMPROVED WET TO DRY TENSILE STRENGTH RATIO

(75) Inventors: Michael Ryan, Newtown, CT (US); William Brevard, Stamford, CT (US)

(73) Assignee: Kemira Oyj (FI)

( * ) Notice: Subject to any disclaimer, the term of this patent is extended or adjusted under 35 U.S.C. 154(b) by 1031 days.

(21) Appl. No.: 10/542,887

(22) PCT Filed: Feb. 6, 2004

(86) PCT No.: PCT/US2004/003412

§ 371 (c)(1),
(2), (4) Date: Jun. 19, 2006

(87) PCT Pub. No.: WO2004/072376

PCT Pub. Date: Aug. 26, 2004

(65) Prior Publication Data

US 2006/0249268 A1 Nov. 9, 2006

(51) Int. Cl.
*D21H 21/18* (2006.01)
*D21H 21/20* (2006.01)

(52) U.S. Cl. ..... 162/164.1; 162/164.4; 162/168.2; 162/168.3; 162/177; 162/179

(58) Field of Classification Search ..... None
See application file for complete search history.

(56) References Cited

U.S. PATENT DOCUMENTS

| | | | | |
|---|---|---|---|---|
| 2,926,154 | A | | 2/1960 | Keim |
| 3,049,469 | A | | 8/1962 | Davison |
| 3,058,873 | A | | 10/1962 | Keim |
| 3,066,066 | A | | 11/1962 | Keim |
| 3,125,552 | A | | 3/1964 | Loshaek |
| 3,186,900 | A | | 6/1965 | DeYoung |
| 3,197,427 | A | | 7/1965 | Schmalz |
| 3,224,986 | A | | 12/1965 | Butler et al. |
| 3,224,990 | A | | 12/1965 | Babcock |
| 3,227,615 | A | | 1/1966 | Korden |
| 3,227,671 | A | | 1/1966 | Keim |
| 3,239,491 | A | | 3/1966 | Tsou |
| 3,240,664 | A | | 3/1966 | Earle, Jr. |
| 3,240,761 | A | | 3/1966 | Keim et al. |
| 3,248,280 | A | | 4/1966 | Hyland, Jr. |
| 3,250,664 | A | | 5/1966 | Conte et al. |
| 3,311,594 | A | | 3/1967 | Earle, Jr. |
| 3,329,657 | A | | 7/1967 | Strazdins et al. |
| 3,332,834 | A | | 7/1967 | Reynolds, Jr. |
| 3,332,901 | A | | 7/1967 | Keim |
| 3,352,833 | A | | 11/1967 | Earle, Jr. |
| 3,442,754 | A | | 5/1969 | Espy |
| 3,459,697 | A | | 8/1969 | Goldberg et al. |
| 3,483,077 | A | | 12/1969 | Aldrich |
| 3,609,126 | A | | 9/1971 | Asao et al. |
| 3,733,290 | A | | 5/1973 | Williams et al. |
| 3,778,339 | A | | 12/1973 | Williams et al. |
| 3,813,362 | A | | 5/1974 | Coscia et al. |
| 4,714,736 | A | | 12/1987 | Juhl et al. |
| 5,239,047 | A | | 8/1993 | Devore et al. |
| 5,393,337 | A | * | 2/1995 | Nakamura et al. ..... 106/238 |
| 5,538,595 | A | * | 7/1996 | Trokhan et al. ..... 162/123 |
| 5,840,403 | A | * | 11/1998 | Trokhan et al. ..... 428/154 |
| 6,261,679 | B1 | * | 7/2001 | Chen et al. ..... 428/317.9 |
| 6,939,443 | B2 | * | 9/2005 | Ryan et al. ..... 162/164.1 |

FOREIGN PATENT DOCUMENTS

| | | |
|---|---|---|
| DE | 2938588 | 4/1981 |
| DE | 3323732 | 1/1985 |
| GB | 1016380 | 1/1966 |
| GB | 1073044 | 6/1967 |
| GB | 1218394 | 1/1971 |
| JP | 07-027833 | 1/1995 |
| JP | 08-008875 | 1/1996 |
| JP | 08-012083 | 1/1996 |
| JP | 08-012088 | 1/1996 |
| WO | WO9920837 | 4/1999 |
| WO | WO2004072376 | 8/2004 |

* cited by examiner

*Primary Examiner*—Philip C Tucker
*Assistant Examiner*—Michael J Felton
(74) *Attorney, Agent, or Firm*—Cantor Colburn LLP

(57) ABSTRACT

The invention relates to a composition comprising (a) a functional promoter comprising a water-soluble anionic polymer having a molecular weight of at least about 50,000 daltons and a molecular weight charge index value of at least about 10,000; (b) a cationic surfactant component; such that when the composition treats a fibrous substrate, in conjunction with a cationic strength agent, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant. The invention also relates to a paper product made with such a system, and method for imparting wet strength to a paper product with the functional promoter.

15 Claims, No Drawings

ANIONIC FUNCTIONAL PROMOTER AND CHARGE CONTROL AGENT WITH IMPROVED WET TO DRY TENSILE STRENGTH RATIO

BACKGROUND

The paper industry currently has no synthetic solution adjunctive to cationic wet strength resins which controls, and preferably improves the wet to dry strength ratio of paper. This ratio is important, as it is a measure of the softness of paper-critical in such products as tissue and towel. Anionic polymers have been shown to improve wet strength of fibrous substrates with the polyamide resin or other cationic strength agents, however, these anionic polymers also improve dry strength thereby maintaining the wet to dry ratio, not improving it. As such, it would be advantageous to develop a composition that enables a market participant to control the wet to dry strength ratio of paper.

SUMMARY

The invention relates to a composition comprising (a) a functional promoter comprising a water-soluble anionic polymer having a molecular weight of at least about 50,000 daltons and a molecular weight charge index value of at least about 10,000; (b) a cationic surfactant component, such that when the composition treats a fibrous substrate, in conjunction with a cationic strength agent, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant.

In one embodiment, the invention relates to a composition comprising (a) a functional promoter comprising a water-soluble anionic polymer having a molecular weight ranging from about 50,000 daltons to about 500,000 daltons and a molecular weight charge index value of more than 10,000 and less than 500,000, (b) a cationic surfactant component present in an amount of less than about 50 wt %, based on the combined weight of the water-soluble anionic polymer and the cationic surfactant component, such that when the composition treats a fibrous substrate, in conjunction with a cationic strength agent, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant.

In another embodiment, the invention relates to a composition comprising a wet-strength enhancing amount of (a) a functional promoter comprising a water-soluble anionic polymer having a molecular weight of at least about 50,000 daltons and a molecular weight charge index value of at least about 10,000, (b) a cationic surfactant component present in an amount of less than about 50 wt %, based on the combined weight of the water-soluble anionic polymer and the cationic surfactant component; and (c) a cationic strength component, such that when the composition treats a fibrous substrate, in conjunction with a cationic strength agent, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant.

In another embodiment, the invention relates to a paper product comprising the reaction product of: (a) a cationic strength component, (b) a fibrous substrate component, and (c) a composition comprising (1) a functional promoter comprising a water-soluble anionic polymer having a molecular weight of at least about 50,000 daltons and a molecular weight charge index value of at least about 10,000 and (2) a cationic surfactant component; such that when the composition treats a fibrous substrate, in conjunction with a cationic strength agent, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant.

In another embodiment, the invention relates to a method for making a paper product comprising adding to a pulp slurry containing a fibrous substrate component a composition comprising: a) a composition comprising (1) a functional promoter comprising (i) a water-soluble anionic polymer having a molecular weight of at least about 50,000 daltons and a molecular weight charge index value of at least about 10,000, (2) a cationic surfactant component present in an amount of less than about 50 wt %, based on the combined weight of the water-soluble anionic polymer and the cationic surfactant component, and (3) a cationic strength component, such that when the composition treats a fibrous substrate, in conjunction with a cationic strength agent, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant.

These and other features, aspects, and advantages of the present invention will become better understood with reference to the following description and appended claims.

DESCRIPTION

The invention is based on the discovery that the use of a functional promoter, in conjunction with a cationic surfactant component, enables the user to achieve full to nearly full wet strength promotion while significantly moderating dry strength promotion.

This significant practical benefit was quite unexpected for a number of reasons. A cationic material will often precipitate an anionic polymer, however, in these studies, the combination formed a homogeneous solution. Additionally, cationic surfactants will often decrease the wet strength of fibrous substrates containing cationic wet strength agents, however, the combination of cationic surfactant with the anionic polymer allows full to nearly full promotion of the cationic strength agent yielding moderated dry tensile yet high wet tensile. Advantageously, the inclusion of optimal amounts of cationic surfactants in the composition allows the use to achieve full to nearly full wet strength promotion while significantly moderating dry strength promotion. The inclusion of the cationic surfactants in the anionic polymer composition allows the product greater application flexibility.

The functional promoter is generally a water-soluble anionic polymer or a water-dispersible polymer having a molecular weight that is at least about 50,000 daltons and a molecular weight charge index value that is at least about 10,000. This material is described in U.S. Ser. No. 10/174,964, incorporated herein by reference in its entirety. As used herein, the term "charge" refers to the molar weight percent of anionic monomers in a functional promoter. For instance, if a functional promoter is made with 30 mole % anionic monomer, the charge of the functional promoter is 30%.

The phrase "molecular weight charge index value" means the value of the multiplication product of the molecular weight and the charge of a functional promoter. For instance, a functional promoter having a molecular weight of 100,000 daltons and a charge of 20% has a molecular weight charge index value that is 20,000. All molecular weights discussed herein are weight average molecular weights. The average molecular weight of a functional promoter can be measured by size exclusion chromatography. When the functional promoter is used in conjunction with a cationic strength agent, the resulting composition imparts improved wet strength to paper products as compared to when the cationic strength agent is used in conjunction with a water-soluble anionic polymer that does not have a molecular weight that is at least about 50,000 daltons and a molecular weight charge index value that is at least about 10,000.

Examples of suitable anionic polymers having a molecular weight that is at least about 50,000 daltons and a molecular weight charge index value that is at least about 10,000 include specific anionic water-soluble or water-dispersible polymers and copolymers of acrylic acid and methacrylic acid, e.g., acrylamide-acrylic acid, methacrylamide-acrylic acid, acrylonitrile-acrylic acid, methacrylonitrile-acrylic acid, provided, of course, that the polymers meet the required molecular weight and molecular weight charge index value. Other examples include copolymers involving one of several alkyl acrylates and acrylic acid, copolymers involving one of several alkyl methacrylates and acrylic acid, anionic hydroxyalkyl acrylate or hydroxyalkyl methacrylate copolymers, copolymers involving one of several alkyl vinyl ethers and acrylic acid, and similar copolymers in which methacrylic acid is substituted in place of acrylic acid in the above examples, provided, of course, that the polymers meet the required molecular weight and molecular weight charge index value. Other examples of suitable anionic polymers having a molecular weight that is at least about 50,000 daltons and a molecular weight charge index value that is at least about 10,000 include those anionic polymers made by hydrolyzing an acrylamide polymer or by polymerizing monomers such as (methyl) acrylic acid and their salts, 2-acrylamido-2-methylpropane sulfonate, sulfoethyl-(meth)acrylate, vinylsulfonic acid, styrene sulfonic acid, maleic or other dibasic acids or their salts or mixtures thereof. Additionally, crosslinking agents such as methylene bisacrylamide may be used, provided, of course, that the polymers meet the above-mentioned molecular weight and molecular weight charge index value.

The functional promoter is made by polymerizing anionic monomers, and non-ionic monomers in the presence of an initiator component and a suitable solvent component under conditions that produce an anionic polymer having a molecular weight that is at least about 50,000 daltons and a molecular weight charge index value that is at least about 10,000. During the preparation of the functional promoter, it is critical that the charge and the molecular weight be controlled so that the resulting polymer has a proper molecular weight and a proper molecular weight charge index value. The charge of the anionic polymer is generally controlled by adjusting the ratios of the anionic monomers and the non-ionic monomers. The molecular weight of the anionic polymer, on the other hand, is adjusted by adjusting the polymerization initiator or a chain-transfer agent.

The way the initiator system is adjusted will depend on the initiator system that is used. If a redox-based initiator is used, for instance, the initiator system is adjusted by adjusting the ratio and the amount of initiator and a co-inititator. If an azo-based initiator system is used, adjustment of the azo-compound will determine the molecular weight of the anionic polymer. Alternatively, a chain transfer agent can be used in conjunction with a redox-based initiator or an azo-based initiator to control the molecular weight of the anionic polymer. Provided that the monomers and inititator components are adjusted to make an anionic polymer having the required molecular weight and molecular weight charge index value, known methods for making acrylic-acrylamide polymers can be modified accordingly to make the functional promoter.

The molecular weight of the functional promoter can differ. In one embodiment, the functional promoter has a molecular weight ranging from about 50,000 to about 5,000,000 daltons, or from about 50,000 to about 4,000,000 daltons, or from about 50,000 to about 3,000,000 daltons, or from about 50,000 to about 2,000,000 daltons, or from about 50,000 to about 1,500,000 daltons, or from about 50,000 to about 1,000,000 daltons. In one embodiment, the functional promoter has a molecular weight ranging from about 50,000 to about 750,000 daltons. In another embodiment, the functional promoter has a molecular weight ranging from about 50,000 to about 650,000 daltons. In another embodiment, the functional promoter has a molecular weight ranging from about 50,000 to about 500,000 daltons. In another embodiment, the functional promoter has a molecular weight ranging from about 300,000 to about 500,000 daltons. In another embodiment, the functional promoter has a molecular weight ranging from about 50,000 to about 250,000 daltons. In another embodiment, the functional promoter has a molecular weight ranging from about 50,000 to about 100,000 daltons. When the functional polymer is in solution, the molecular weight of the functional promoter is preferably less than 5,000,000 daltons.

Similarly, the molecular weight charge index value of the functional promoter can differ. In one embodiment, the functional promoter has a molecular weight charge index value ranging from about 10,000 to about 1,000,000. In another embodiment, the functional promoter has a molecular weight charge index value ranging from about 10,000 to about 500,000. In another embodiment, the functional promoter has a molecular weight charge index value ranging from about 10,000 to about 450,000. In another embodiment, the functional promoter has a molecular weight charge index value ranging from about 10,000 to about 300,000. In another embodiment, the functional promoter has a molecular weight charge index value ranging from about 10,000 to about 150,000. In another embodiment, the functional promoter has a molecular weight charge index value ranging from about 25,000 to about 100,000. In one embodiment, the charge is of the functional promoter is at least 50%.

When used in an aqueous solution, the functional promoter generally has a viscosity that is less than 2,500 cP and more than 25 cP when the solution has a concentration of 15% by weight of the functional promoter. The polymer solution was diluted to 15% using deionized water. The viscosity was then measured using a Brookfield DVII instrument with spindle #2 at 12 rpm at 25° C.

The cationic surfactant component can be any cationic material, which when used in accordance with the invention, provides a composition of the invention. Examples of suitable cationic materials include alkylated quaternary amines, alkyl aryl quaternary amines, alkoxylated quaternary amines, imidazolinium quaternary amines, functionalized polysiloxanes, and combinations thereof.

The cationic surfactant component is used in an amount that is at least about 5%, based on the total weight of the composition. In one embodiment, the cationic surfactant component is ranging from about 10% to about 50%, based on the total weight of the composition. In another embodiment, the cationic surfactant component is present in an amount ranging from about 5% to about 40%, or from about 20% to about 40%, based on the total weight of the composition.

The cationic strength component includes a cationic resin, which when used in conjunction with the functional promoter, has an improved wet strength-imparting capacity, as compared to when the cationic strength agent is used in conjunction with a water-soluble anionic polymer that does not have a molecular weight that is at least about 50,000 daltons and does not have a molecular weight charge index value that is more than 10,000.

The cationic strength component can include any polyamide wet strength resin, which when used in conjunction with a functional promoter, exhibits increased wet-strength imparting properties. Useful cationic thermosetting polyamide-epichlorohydrin resins include a water-soluble polymeric reaction product of epichlorohydrin and a polyamide derived from a polyalkylene polyamine and a $C_3$-$C_{10}$ saturated aliphatic dicarboxylic acid, an aromatic dicarboxylic acid, oxalic acid, or urea. In the preparation of these cationic thermosetting resins, the dicarboxylic acid first reacts with the polyalkylene polyamine under conditions that produce a water-soluble polyamide containing the recurring groups:

$$—N(CH_2—CH_2—NH]_n—CORCO]_x,$$

in which n and x are each 2 or more and R is the divalent hydrocarbon radical of the dicarboxylic acid. This water-soluble polyamide then reacts with epichlorohydrin to form the water-soluble cationic thermosetting resin.

Other patents teaching the preparation and/or use of aminopolyamide-epichlorohydrin resins in wet strength paper applications include U.S. Pat. Nos. 5,239,047, 2,926,154, 3,049,469, 3,058,873, 3,066,066, 3,125,552, 3,186,900, 3,197,427, 3,224,986, 3,224,990, 3,227,615, 3,240,664, 3,813,362, 3,778,339, 3,733,290, 3,227,671, 3,239,491, 3,240,761, 3,248,280, 3,250,664, 3,311,594, 3,329,657, 3,332,834, 3,332,901, 3,352,833, 3,248,280, 3,442,754, 3,459,697, 3,483,077, 3,609,126, and 4,714,736; British patents 1,073,444 and 1,218,394; Finnish patent 36,237 (CA 65: 50543d); French patent 1,522,583 (CA 71: 82835d); German patents 1,906,561 (CA 72: 45235h), 2,938,588 (CA 95: 9046t), 3,323,732 (CA 102: 151160c); Japanese patents 70 27,833 (CA 74: 4182m), 71 08,875 (CA 75: 49990k), 71 12,083 (CA 76: 115106a); 71 12,088 (CA 76: 115107b), 71 36,485 (CA 77: 90336f); Netherlands application 6,410,230 (CA 63: P5858h); South African patent 68 05,823 (CA 71: 114420h); and Swedish patent 210,023 (CA 70: 20755y).

Other suitable cationic strength agents include cationic polyvinylamides suitable for reaction with glyoxal, including those which are produced by copolymerizing a water-soluble vinylamide with a vinyl, water-soluble cationic monomer when dissolved in water, e.g., 2-vinylpyridine, 2-vinyl-N-methylpyridinium chloride, diallyldimethylammonium chloride, (p-vinylphenyl)-trimethylammonium chloride, 2-(dimethylamino)ethyl acrylate, methacrylamide propyl trimethyl ammonium chloride, and the like.

Alternatively, glyoxylated cationic polymers may be produced from non-ionic polyvinylamides by converting part of the amide substituents thereof (which are non-ionic) to cationic substituents. One such polymer can be produced by treating polyacrylamide with an alkali metal hypohalite, in which part of the amide substituents are degraded by the Hofmann reaction to cationic amine substituents (see U.S. Pat. No. 2,729,560). Another example is the 90:10 molar ratio acrylamide; p-chloromethylstyrene copolymer which is converted to a cationic state by quaternization of the chloromethyl substituents with trimethylamine. The trimethylamine can be replaced in part or in whole with triethanolamine or other water-soluble tertiary amines. Alternatively still, glyoxylated cationic polymers can be prepared by polymerizing a water-soluble vinyl tertiary amine (e.g., dimethylaminoethyl acrylate or vinylpyridine) with a water-soluble vinyl monomer copolymerizable therewith, e.g., acrylamide, thereby forming a water-soluble cationic polymer. The tertiary amine groups can then be converted into quaternary ammonium groups by reaction with methyl chloride, dimethyl sulfate, benzyl chloride, and the like, in a known manner, and thereby producing an enhancement of the cationic properties of the polymer. Moreover, polyacrylamide can be rendered cationic by reaction with a small amount of glycidyl dimethyl-ammonium chloride.

The composition is made by any method that enables the functional promoter and the cationic surfactant component to be combined so that the composition forms. Preferably, the composition is made by simply blending the surfactant into the anionic polymer solution homogeneously.

The composition and the cationic strength component are used in amounts sufficient to enhance the wet strength of a paper product. The specific amount of the composition and the cationic strength component will depend on, among other things, the type of pulp properties. The ratio of the functional promoter to the cationic strength component may range from about 1/20 to about 1/1, preferably from about 2/1 to about 1/10, and more preferably about 1/4. The ratio of the cationic surfactant component to the functional promoter may range from about 1/20 to about 1/2, preferably from about 1/10 to about 1/2, and more preferably about 1/3.

The fibrous substrate of the invention can include any fibrous substrate of a pulp slurry used to make paper products. Generally, the invention can be used in slurries for making dry board, fine paper, towel, tissue, and newsprint products. Dry board applications include liner board, medium board, bleach board, and corrugated board products.

The paper products produced according to the invention may contain known auxiliary materials that can be incorporated into a paper product such as a paper sheet or a board by addition to the pulp at the wet end, directly to the paper or board or to a liquid medium, e.g., a starch solution, which is then used to impregnate a paper sheet or a board. Representative examples of auxiliary agents include defoamers, bacteriocides, pigments, fillers, and the like.

In use, the invention provides a method for imparting wet strength to a paper product a wet-strength enhancing amount of (a) a functional promoter comprising a water-soluble anionic polymer having a molecular weight of at least about 50,000 daltons and a molecular weight charge index value of at least about 10,000, (b) a cationic surfactant component present in an amount of less than about 50 wt %, based on the combined weight of the water-soluble anionic polymer and the cationic surfactant component; and (c) a cationic strength component, such that when the composition treats a fibrous substrate, in conjunction with a cationic strength agent, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant The cationic strength component and the composition each are generally added to a dilute aqueous suspension of paper pulp and the pulp is subsequently sheeted and dried in a known manner. Preferably, the cationic strength component and the composition are added in dilute aqueous solutions. More particularly, the cationic strength component and the composition are desirably added to the slurry in the form of dilute aqueous solutions at solids concentrations that are at least about 0.2%, preferably from about 1.5 to about 0.5%. The papermaking system (pulp slurry and dilution water) may be acidic, neutral or alkaline. The preferred pH range is from about 4.5 to 8. The cationic strength agent can be used with cationic performance agents such as cationic starch. The dosages at which the composition and the cationic strength component are added varies, depending on the application. Generally, the dosage of the composition is at least about 0.1 lb/ton (0.005 wt %). The functional promoter dosage can range from about 0.1 lb/ton (0.005 wt %) to about 20 lbs/ton (1 wt %), or from about 3 lbs/ton (0.15 wt %) to about 20 lbs/ton (0.75 wt %), or from about 4 lbs/ton (0.2 wt %) to about 20 lbs/ton (1 wt %), or from about 2 lbs/ton (0.1 wt %) to about 5 lbs/ton (0.25 wt %). The dosage at which the cationic strength component is added is generally at least 0.1 lb/ton (0.005 wt %). The cationic strength component dosage can range from about 0.1 lb/ton (0.005 wt %) to about 100 lbs/ton (5 wt %), or from about 5 lbs/ton (0.25 wt %) to about 50 lbs/ton (2.5 wt %), or from about 10 lbs/ton (0.5 wt %) to about 30 lbs/ton (1.5 wt %), or from about 10 lbs/ton (0.5 wt %) to about 24 lbs/ton (1.2 wt %).

The composition may be added into a pulp slurry by any suitable means. Preferably, the composition is added after the cationic strength agent component is added. However, the composition may be added either before or after the cationic strength agent, still yielding excellent performance. This significant practical benefit was quite unexpected.

The invention provides valuable benefits to the industry. This invention, depending on the application, can provide desired wet tensile strength:dry tensile strength ratios to a paper product. The invention can also allow for the use of lower polyamide resin dosages, thereby decreasing undesirable volatile organic compound (VOC) and dichloro-propanol (DCP) levels. The effectiveness of the composition substantially reduces or eliminates the need to use carboxymethylcellulose, and thereby avoids the disadvantages of using carboxymethylcellulose. The functional promoter is synthetic and, therefore, the charge and molecular weight are controllable. Also, it is a "pump-and-go" solution, and thereby is a flexible practical solution. The invention can also be effective at a lower dose than carboxymethyl-cellulose and is a more effective charge control agent. Although the invention is useful in imparting wet strength to paper products, the invention can also impart dry strength to paper products.

The invention is further described in the following illustrative examples in which all parts and percentages are by weight unless otherwise indicated.

EXAMPLES

Example 1

Preparation of a Poly(acrylamide$_{50}$-co-acrylic acid$_{50}$)

28.93 parts acrylic acid, 53.15 parts acrylamide (53.7% solution in water), 0.06 parts ethylenediaminetetraacetic acid disodium salt, and 17.9 parts water were charged to vessel "A" and agitated. The pH of the resulting mixture was adjusted to pH 4.0 using caustic soda. 0.28 parts ammonium persulfate in water solution were charged to vessel "B" and 0.84 parts sodium metabisulfite in water solution were charged to vessel "C." 119.76 parts water were charged to a reactor heel and agitated. The heel was brought to reflux and vessels A, B and C were charged to the reactor continuously over a 72-minute period. The reflux was continued for 30 minutes after the charges were completed. The molecular weight of the polymer was approximately 111,000 daltons. The charge of the polymer was approximately 50%.

Example 2

Preparation of a Glyoxalated Poly(acrylamide-co-acrylic acid)

100.00 parts polymer solution from Example 1 were charged to a reaction vessel and agitated. 18.85 parts glyoxal (40% solution, in water) and 64.60 parts water were charged to a reaction vessel and the pH was adjusted to 8.5 using caustic soda. When the viscosity of the solution reached 26-28 seconds in a #3 Shell cup, the reaction was quenched with sulfuric acid to pH 2.9-3.1. The charge of the polymer was approximately 50%.

Example 3

Preparation of Glyoxalated Acrylamide-itaconic acid-Diallyidimethyl Ammonium Chloride Terpolymers 100 parts acrylamide (52.7%), 10.6 parts itaconic acid (99%), 3.13 parts diallyldimethylammonium chloride (58.5%) were charged to a first vessel. Water was then charged to the first reaction vessel and the solution was diluted to 26% solids, and the solution was then agitated and sparged with nitrogen. 5.69 parts 2-mercaptoethanol (98%) were charged to the first reaction vessel and agitated. 9.32 parts ammonium persulfate (13.3%) were charged into the first vessel and maintained at a temperature of 70° C. 29.1 parts each of ammonium persulfate and sodium metabisulfite (2%) solutions were charged to the first vessel over one hour. The mixture was heated for one hour after completion. 150 parts of this polymer backbone was then charged to a second reaction vessel and agitated. 58.1 parts water and 32.7 parts glyoxal (40%) were charged to the second reaction vessel. The pH was adjusted to 8.3 using caustic soda. At a Shell cup viscosity of 26-27 seconds, the pH was reduced to 2.9-3.1 using sulfuric acid.

Examples 4-16

Wet Strength Evaluation

To evaluate the wet strength of a cationic strength component without use of a functional promoter in accordance to the invention, the following procedure was practiced. 1667 g of 0.6% consistency 50/50 hardwood/softwood furnish containing 200 ppm sulfates and 50 ppm calcium was adjusted to pH 7.5 using sodium hydroxide. A dilute solution of polyamide resin was mixed into the pulp slurry at the dosage level of 10 lbs/ton (0.5 wt %) for 30 seconds. To evaluate the wet tensile strength of the paper product formed, three 2.8 g handsheets, each approximately a square having an edge of 8 inches, 64 square inches (416 $cm^2$), were formed from each batch using a Noble & Wood handsheet former. The formed sheets were pressed between felts in the nip of press rolls, and then drum dried on a rotary drier for one minute at 240° F. (116° C.). The sheets were conditioned at 73° F. (23° C.) and 50% relative humidity before measuring the wet tensile using a Thwing-Albert tensile tester. The wet tensile strength of the paper was determined.

To evaluate how a functional promoter with different molecular weight and charge properties would impact the wet strength of the paper product, the procedure described above was repeated, except that dilute solutions containing anionic polymers indicated below in Tables 1 and 2 were added for 30 seconds after the polyamide resin was added. Each anionic polymer was prepared using the same general procedure as in Example 1, and the monomer and catalyst ratios were adjusted as appropriate to produce an anionic polymer having the desired molecular weight and molecular weight charge index value.

Table 1 below indicates the dosages of the cationic strength agent (PAE), the anionic polymer and the molecular weight (MW) of the anionic polymers for Examples 4-16. The dosages are given in (lbs/ton) and (weight %).

TABLE 1

| Example | Dose of PAE lbs/ton (wt %) | Dose of Anionic Polymer lbs/ton (wt %) | Anionic Polymer (MW) |
|---|---|---|---|
| 4 | 10 (.5) | 0 | N/A* |
| 5 | 10 (.5) | 2 (.1) | 5,000 |
| 6 | 10 (.5) | 2 (.1) | 10,000 |
| 7 | 10 (.5) | 2 (.1) | 250,000 |
| 8 | 10 (.5) | 3 (.15) | 5,000 |
| 9 | 10 (.5) | 3 (.15) | 10,000 |
| 10 | 10 (.5) | 3 (.15) | 250,000 |
| 11 | 10 (.5) | 4 (.2) | 5,000 |
| 12 | 10 (.5) | 4 (.2) | 10,000 |
| 13 | 10 (.5) | 4 (.2) | 250,000 |
| 14 | 10 (.5) | 5 (.25) | 5,000 |
| 15 | 10 (.5) | 5 (.25) | 10,000 |
| 16 | 10 (.5) | 5 (.25) | 250,000 |

*Not Applicable

Table 2 summarizes the anionic polymer charge, the molecular weight index value, the wet tensile strength, and the wet strength enhancement that was achieved in Examples 4-16:

TABLE 2

| Example | Anionic Polymer Charge mole % | MW Charge Index Value | Wet Tensile Strength | Wet Strength Enhancement % |
|---|---|---|---|---|
| 4 | N/A | N/A | 3.90 | N/A |
| 5 | 8 | 400 | 3.84 | −2 |
| 6 | 70 | 7000 | 3.79 | −3 |
| 7 | 8 | 20,000 | 4.30 | 10 |
| 8 | 8 | 400 | 3.95 | 1 |
| 9 | 70 | 7,000 | 3.28 | −16 |
| 10 | 8 | 20,000 | 4.20 | 8 |
| 11 | 8 | 400 | 4.07 | 4 |
| 12 | 70 | 7,000 | 3.56 | −9 |
| 13 | 8 | 20,000 | 4.44 | 14 |
| 14 | 8 | 400 | 3.90 | 0 |
| 15 | 70 | 7,000 | 3.46 | −11 |
| 16 | 8 | 20,000 | 4.21 | 8 |

The results indicated that, for a given trial at each specified dose, the trials in which a water-soluble anionic polymer having a molecular weight of at least 50,000 daltons and a molecular weight charge index value that was more than 10,000 (functional promoter) exhibited better results than those systems that used a water-soluble anionic polymer having a molecular weight that was less than 50,000 daltons and a molecular weight charge index value that was less than 10,000. In fact, the low molecular weight anionic polymers (5,000-10,000 daltons) across a range of charges yielded poor promotion and in some cases even had negative impact on wet strength. In view of what is known in the art, such results would not have been expected.

Examples 17-23

1667 g of 0.6% consistency 50/50 hardwood/softwood furnish containing 200 ppm sulfates and 50 ppm calcium was adjusted to a pH of 7.5 using sodium hydroxide. A dilute solution of polyamide resin was mixed into the pulp slurry at a dosage level of 16 lbs/ton (0.8 wt %) for 30 seconds.

To evaluate the wet tensile strength of the paper product formed, three 2.8 g handsheets, each approximately 64 square inches (416 $cm^2$), were formed from each batch using a Noble & Wood handsheet former. The formed sheets were pressed between felts in the nip of press rolls, and then drum dried on a rotary drier for one minute at 240° F. (116° C.). The sheets were conditioned at 73° F. (23° C.) and 50% relative humidity before measuring the wet tensile with a Thwing-Albert tensile tester. The wet tensile strength of the paper was determined.

To evaluate the effect of adding functional promoters having different molecular weights and different molecular weight charge index values, the procedure described above was repeated, except that dilute solutions containing the anionic polymer indicated below were added for 30 seconds after the polyamide resin was added.

The anionic polymer was prepared using the same general procedure as in Example 1, and the monomer and initiator ratios were adjusted as appropriate to produce an anionic polymer having a desired molecular weight and molecular weight charge index value.

Table 3 below summarizes the dosages of the cationic strength PAE), the anionic polymer and the molecular weight (MW) of the polymers for Examples 17-23. The dosages are given in (lbs/ton) and weight %.

TABLE 3

| Example | Dose of PAE lbs/ton (wt %) | Dose of anionic polymer lbs/ton (wt %) | Anionic Polymer (MW) |
|---|---|---|---|
| 17 | 16 (.8) | 0 | N/A |
| 18 | 16 (.8) | 4 (.2) | 50,000 |
| 19 | 16 (.8) | 4 (.2) | 50,000 |
| 20 | 16 (.8) | 4 (.2) | 100,000 |
| 21 | 16 (.8) | 4 (.2) | 100,000 |
| 22 | 16 (.8) | 4 (.2) | 200,000 |
| 23 | 16 (.8) | 4 (.2) | 200,000 |

Table 4 summarizes the anionic polymer charge, the molecular weight index value, the wet tensile strength, and the wet strength enhancement that was achieved in Examples 17-23:

TABLE 4

| Example | Anionic Polymer (Charge) mole % | MW Charge Index Value | Wet Tensile | Wet Strength Enhancement % |
|---|---|---|---|---|
| 17 | N/A | N/A | 3.69 | 0 |
| 18 | 20 | 10,000 | 4.11 | 11 |
| 19 | 50 | 25,000 | 4.43 | 20 |
| 20 | 20 | 20,000 | 4.27 | 16 |
| 21 | 50 | 50,000 | 4.55 | 23 |
| 22 | 20 | 40,000 | 4.51 | 22 |
| 23 | 50 | 100,000 | 4.49 | 22 |

These examples show that the system in which the polymer having an average molecular weight of at least about 50,000 daltons and a molecular weight charge index value of more than 10,000 (functional promoter) imparted significantly more wet strength than the system in which no functional promoter was used. Remarkably, when the molecular weight of the anionic polymer was approximately 50,000, the wet strength enhancement nearly doubled when the charge of the anionic polymer was increased from 20 to 50 mole %.

Examples 24-27

Promotion of Polyamide with Glyoxalated Poly(acrylamide-co-acrylic acid)

This example shows glyoxalated poly(acrylamide-co-acrylic acid) functional promoters of a specified charge enhancing the wet-strength properties of a polyamide resin. The polymers were prepared using the same general procedure as in Example 2, adjusting the monomer and initiator ratios as appropriate to obtain the charge % indicated below in Tables 5 and 6. Backbone molecular weight prior to glyoxylation was approximately 30,000 daltons in these examples. Post-glyoxalation molecular weights were much higher, approximately 1,500,000 daltons. Promotion studies were completed in handsheets using 50/50 hardwood/softwood furnish at a pH of 7.5 and a basis weight of 50 lb/ton.

Polyamide wet strength agent was promoted using a glyoxalated poly (acrylamide-co-acrylic acid) copolymer of a specified charge.

Table 5 below indicates the dosages of the cationic strength agent (PAE), the anionic polymer and the molecular weight (MW) of the anionic polymers for Examples 24-27. The dosages are given in lbs/ton and weight % (wt %).

TABLE 5

| Example | Dosage of PAE lbs/ton (wt %) | Dosage of Anionic Polymer lbs/ton (wt %) | Anionic Polymer (MW) |
|---|---|---|---|
| 24 | 20 (1) | 0 | N/A |
| 25 | 16 (.8) | 4 (.2) | 1,500,000 |
| 26 | 16 (.8) | 4 (.2) | 1,500,000 |
| 27 | 16 (.8) | 4 (.2) | 1,500,000 |

Table 6 summarizes the anionic polymer charge, the molecular weight index value, and the wet strength enhancement that was achieved 24-27:

TABLE 6

| Example | Anionic Polymer Charge Mole % | MW Charge Index Value | Wet tensile strength | Wet Strength Enhancement (%) |
|---|---|---|---|---|
| 24 | N/A | N/A | 3.53 | 0 |
| 25 | 10 | 150,000 | 3.76 | 7 |
| 26 | 20 | 300,000 | 4.07 | 15 |
| 27 | 30 | 450,000 | 4.07 | 15 |

The above shows glyoxalated anionic polyacrylamide functional promoters effectively promoting the strength-enhancing properties of polyamide wet strength agents. When the charge of the anionic polymer increased from 10 to 20 or 30%, respectively, the wet strength enhancement to the paper more than doubled.

Examples 28-34

These examples show the promotion of a polyamide (PAE) strength resin with a composition of the invention.

The functional promoter from Example 1 was blended with cationic surfactants, as described below. The wet tensile to dry tensile ratio was increased significantly, as shown in Table 7. An additional unforeseen benefit observed with this composition was the ability to add the promoter prior to the PAE where as a single component the user is limited to adding the promoter only after the PAE. This allows the user greater flexibility in his mill process such that the product is much more user friendly and the user is much less likely to harm strength due to poor addition points and/or poor mixing.

TABLE 7

| Example | Resin 1 | Dose | Resin 2 | Dose | Dry Tensile | Wet Tensile | % W/D |
|---|---|---|---|---|---|---|---|
| 28 | Blank | | | | 12.2 | 0.32 | 2.6 |
| 29 | PAE resin | 16 | | | 14.7 | 3.2 | 21.8 |
| 30 | PAE resin | 16 | FP | 3.1 | 18.59 | 4 | 21.5 |
| 31 | PAE resin | 16 | FP + Surf 1 | 3.1 | 16.4 | 3.9 | 23.8 |
| 32 | Functional promoter (FP) | 3.1 | PAE | 16 | 14.11 | 2.7 | 19.1 |

TABLE 7-continued

| Example | Resin 1 | Dose | Resin 2 | Dose | Dry Tensile | Wet Tensile | % W/D |
|---|---|---|---|---|---|---|---|
| 33 | FP + Surf 1 | 3.1 | PAE | 16 | 16 | 3.8 | 23.8 |
| 34 | PAE resin | 16 | A Polymer + Surf 2 | 3.1 | 16.9 | 4 | 23.7 |

Functional Promoter is from Example 1.
Surf1 is an imidazole-type surfactant
Surf2 is a sulfosuccinate-type surfactant The results show that the PAE resin alone increased dry tensile slightly but increased wet tensile dramatically yielding a greatly improved W/D compared with the blank. Addition of the functional promoter boosts both wet and dry tensile leaving the W/D virtually unchanged. Addition of the composition containing the surfactant "Surf1" enhances W/D by approximately 10% compared with either the PAE alone or the PAE/anionic polymer system. When the functional promoter is added prior to the PAE, the wet tensile is actually decreased by nearly 16% compared with PAE alone rather than improved. However, with the composition is used, the wet tensile is improved by nearly 19% compared to PAE alone, a similar amount to the reverse addition and 41% better than the anionic polymer/PAE system alone. Finally, the composition containing the surfactant "Surf2" also improves W/D vs. PAE.

Example 35

The procedure of Example 31 was repeated, except that instead of using a cationic surfactant, each the following anionic surfactants was tested: odium dioctyl sulfosuccinate, sodium dihexyl sulfosuccinate, sodium diamyl sulfosuccinate, sodium dibutyl sulfosuccinate, sodium bistridecyl sulfosuccinate, sodium salt of sulfated nonylphenoxy poly-(ethyleneoxy) ethanol, and sodium salt of sulfonated chloroparaffin. It was observed that gellation and/or separation occurred when each anionic surfactant was used, such that when the functional promoter and the anionic surfactant treated a fibrous substrate, in conjunction with the cationic strength agent (the PAE resin), the treated fibrous substrate did not exhibit (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate was treated with the functional promoter and without a surfactant.

Although the present invention has been described in detail with reference to certain preferred versions thereof, other variations are possible. Therefore, the spirit and scope of the appended claims should not be limited to the description of the versions contained therein.

What is claimed is:

1. A method for making a paper product comprising adding to a pulp slurry containing a fibrous substrate component a composition comprising:

(a) a composition comprising (1) a functional promoter comprising (i) a water-soluble anionic polymer having a molecular weight of at least about 50,000 daltons and a molecular weight charge index value of at least about 10,000, (2) a cationic surfactant component present in an amount of less than about 50 wt %, based on the combined weight of the water-soluble anionic polymer and the cationic surfactant component, and (3) a cationic strength component, wherein when the composition treats a fibrous substrate, the treated fibrous substrate exhibits (i) a ratio of wet tensile strength to dry tensile strength ranging from about 1:5 to about 1:2 and (ii) an increase in a ratio of wet tensile strength to dry tensile strength of at least about 10%, as compared to when the fibrous substrate is treated with the functional promoter and without a surfactant.

2. The method of claim 1, wherein the functional promoter has a molecular weight ranging from about 50,000 to about 500,000 daltons.

3. The method of claim 1, wherein the functional promoter has a molecular weight ranging from about 50,000 to about 250,000 daltons.

4. The method of claim 1, wherein the functional promoter has a molecular weight ranging from about 50,000 to about 100,000 daltons.

5. The method of claim 1, wherein the functional promoter has a molecular weight ranging from about 300,000 to about 500,000 and charge.

6. The method of claim 1, wherein the functional promoter has a molecular weight charge index value ranging from about 10,000 to about 100,000.

7. The method of claim 1, wherein the functional promoter has a molecular weight charge index value ranging from about 25,000 to about 100,000.

8. The method of claim 1, wherein the functional promoter is in solution.

9. The method of claim 1, wherein the molecular weight of the functional promoter is less than 5,000,000 daltons.

10. The method of claim 1, wherein the functional promoter is selected from the group consisting of copolymers of acrylic acid, copolymers of acrylamide-acrylic acids, copolymers of methacrylic acid, copolymers having alkyl acrylates and acrylic acid, copolymers of alkyl methacrylates and acrylic acid, anionic hydroxyalkyl acrylate copolymers, hydroxy alkyl methacrylate copolymers, copolymers of alkyl vinyl ethers and acrylic acid, anionic polymers made by hydrolyzing an acrylamide polymer, anionic polymers made by polymerizing (i) (methyl)acrylic acid, (ii) (methyl)acrylic acid salts, (iii) 2-acrylamido-2-methylpropanesulfonate, (iv) sulfoethyl-(meth)acrylate, (i) vinylsulfonic acid, (v) styrene sulfonic acid, (vi) dibasic acids, (vii) salts of the foregoing monomers, and mixtures thereof, and anionic polymers made with crosslinking agents.

11. The method of claim 3, wherein the cationic strength component is a polyamide wet strength resin or a glyoxylated cationic polymer or a polyamide wet strength resin and a cationic starch.

12. The method of claim 1, wherein the fibrous substrate component is selected from the group consisting of fine paper pulp slurries, newsprint pulp slurries, board pulp slurries, towel pulp slurries, and tissue pulp slurries.

13. The method of claim 1, wherein the fibrous substrate is a board pulp slurry.

14. The method of claim 1, wherein the functional promoter and the cationic strength component are present at a functional promoter:cationic strength component ratio ranging from about 1/20 to about 1/1.

15. The method of claim 1, wherein the composition is added to the slurry at a dosage of at least about 0.1 lb/ton and the cationic strength component is added to the slurry at a dosage of at least about 0.1 lb/ton.

* * * * *